US006309092B1

(12) United States Patent
Bardeen et al.

(10) Patent No.: US 6,309,092 B1
(45) Date of Patent: Oct. 30, 2001

(54) ILLUMINATION DEVICE FOR ILLUMINATING AN OBJECT'S INTERIOR

(75) Inventors: Kea L. Bardeen, Lakewood; Barry P. Brown, Denver, both of CO (US)

(73) Assignee: Pumpkin Ltd., Denver, CO (US)

( * ) Notice: Subject to any disclaimer, the term of this patent is extended or adjusted under 35 U.S.C. 154(b) by 0 days.

(21) Appl. No.: 09/163,744

(22) Filed: Sep. 30, 1998

(51) Int. Cl.[7] ..... F21V 21/00

(52) U.S. Cl. ..... 362/392; 362/202; 362/363; 362/808; 362/810

(58) Field of Search ..... 362/363, 806, 362/808, 392, 205, 202, 810

(56) References Cited

U.S. PATENT DOCUMENTS

| | | | | |
|---|---|---|---|---|
| 4,203,150 | * | 5/1980 | Shamlian | 362/202 |
| 4,866,580 | * | 9/1989 | Blackerby | 362/810 |
| 4,955,807 | * | 9/1990 | Chance et al. | 362/806 |
| 5,091,833 | * | 2/1992 | Paniaguas et al. | 362/191 |
| 5,152,602 | * | 10/1992 | Boschetto | 362/810 |
| 5,174,645 | * | 12/1992 | Chung | 362/810 |
| 5,327,332 | * | 7/1994 | Hafemeister | 362/810 |
| 5,918,964 | * | 7/1999 | Bou | 362/806 |
| 6,086,221 | * | 7/2000 | Wu | 362/249 |

* cited by examiner

*Primary Examiner*—Sandra O'Shea
*Assistant Examiner*—John Anthony Ward
(74) *Attorney, Agent, or Firm*—Timothy J. Martin; Michael R. Henson; Mark H. Weygandt

(57) ABSTRACT

An illumination device is adapted to be placed in an interior of an object to illuminate a surrounding area, and comprises a housing, a light source and a decorative skirt. The housing has an interior sized and adapted to receive an electric power supply, and includes a base portion operative to support the housing in an upright orientation relative to a support surface of the object and an upper end portion opposite the base portion. The light source is disposed at the upper end portion and a decorative skirt surrounds the upper end portion and depends downwardly alongside an outer surface thereof. Preferably, the decorative skirt simulates the appearance of wax drippings and the electric power supply includes one or more batteries suspended within the housing.

26 Claims, 3 Drawing Sheets

ILLUMINATION DEVICE FOR ILLUMINATING AN OBJECT'S INTERIOR

FIELD OF THE INVENTION

The present invention relates to an illumination device adapted to be placed in an interior of an object to illuminate a surrounding area. More particularly, the present invention is directed to a illumination device adapted to be placed in a hollowed-out interior of a carved fruit having a fleshy bottom wall, such as a pumpkin or a watermelon, to illuminate the interior so as to project a decorative image carved in the sidewall thereof.

BACKGROUND OF THE INVENTION

Pumpkin carving has become a popular past time especially during the Halloween season. In fact, pumpkin carving has become so popular that there is now a demand for a variety of pumpkin carving implements including pumpkin face patterns, carving tools and drilling tools, as well as a variety of pumpkin carving kits. These pumpkin carving implements and kits can be used by children or adults with a carving skill level ranging from a hobbyist to a professional.

Often during the Halloween season, scary faces, characters or other images are carved into pumpkin shells, and during night hours, a lit candle is placed into the pumpkin shell so that the image is brightly illuminated in the dark of night for view by any passers-by. Either short, slender candles or votive candles are typically employed for this purpose. Usually, votive candles are set, unsecured, into the pumpkin. Homemade holders of aluminum foil, or candles set onto plates with wax are sometime used to hold candles. None of these methods holds the candles securely, allowing them to tip over and be extinguished or even permitting them to fall out of the pumpkin. Also, none of these methods contains the wax of votive candles, causing a reduction in burning time.

Additionally, as candles burn in pumpkins, it is necessary to provide a chimney or flue so that smoke and heat from the candle can escape. This flue or chimney is usually carved with a knife and consequently appears as an unsightly non-uniform, polygonal hole. This chimney is typically located at the top of the pumpkin proximately to the stem. Due to the thickness of the pumpkin shell near the stem, the difficulty of cutting such a chimney with a knife is increased as is the risk of injury to the carver.

Another drawback of these existing techniques in illuminating carved pumpkins is that, as the candle burns over a period of time, it diminishes in size thereby effecting overall illumination of the carved pumpkin. Additionally, where the pumpkin is located outdoors, there remains the possibility that a gust of wind will merely extinguish the lit candle.

There is therefore, a need in the industry to provide an alternative means for illuminating the interior of a carved pumpkin or the like. It is further desirable for an illumination device accomplishing this need to eliminate the drawbacks caused by the wax of votive candles and to eliminate the need for providing a chimney or flue in the pumpkin, while increasing both illumination time and efficiency. Moreover, a need exists for a lightweight, inexpensive illumination device which may be planted into the fleshy shell of a carved pumpkin so that the pumpkin will securely hold the illumination device. Such an illumination device should be capable of inclusion in a kit or sold alone. The present invention satisfies these needs and provides these benefits.

SUMMARY OF THE INVENTION

It is an object of the present invention to provide a new and improved illumination device adapted to be placed in an interior of an object, such as a carved pumpkin or some other fruit or vegetable, to illuminate a surrounding area or an image carved therein.

Another object of the present invention is to provide an illumination device which is configured to be securely supported in the interior of an object to reduce the likelihood of tipping.

A further object of the present invention is to provide an illumination device having a self-contained electrical power supply which is readily replaceable.

Still another object of the present invention is to provide a new and improved illumination device for pumpkins or some other fruit or vegetable which does not generate any smoke or appreciable amount of heat, thereby eliminating the need for a chimney or flue.

Still a further object of the present invention is to provide an illumination device which is light-weight, easy and safe to use, and inexpensive to manufacture.

In accordance with these objectives, an illumination device according to the present invention is adapted to illuminate a surrounding area. The illumination device may be placed in an interior of an object, such as the hollowed-out interior of a pumpkin having a fleshy bottom wall. The illumination device broadly comprises a stand having a base portion and a body portion extending upwardly from the base portion in a longitudinal direction to terminate at upper end, and a light assembly supported relative to the upper end in an elevated position above the base portion.

The stand may be in the form of a housing having an elongated tubular sidewall which extends from the base portion to terminate at an open upper end so that the sidewall surrounds a stand interior. The base portion is operative to support the housing in an upright orientation relative to a support surface, such as a pumpkin's fleshy bottom wall. Preferably, the base portion is formed as an extension of the sidewall and includes a lower base portion edge. The base portion may be configured to penetrate the support surface and, to this end, the base portion edge is serrated so that the base portion includes a plurality of downwardly projecting teeth. The base portion also preferably includes a transversely extending limit stop located above these teeth, and this limit stop operates to resist insertion of the base portion beyond a selected penetration depth. Where the sidewall is tubular in construction, this limit stop is formed by a transversely extending base wall located in a spaced relation to the base portion edge.

The light assembly which may emit either a continuous or intermittent glow, includes a self-contained power supply, such as one or more batteries, and an incandescent bulb in electrical communication with the power supply. The power supply is disposed within the stand interior between the base wall and the upper end and is preferably suspended within the tubular housing. Where two batteries are utilized, a battery chamber is provided which is sized and adapted to house these batteries. The light assembly also includes a lid sized and adapted to rest on the open upper end of the stand's tubular sidewall. The power supply and the incandescent bulb are each supported by this lid so that the bulb projects upwardly from a lid seat and the power supply is suspended downwardly from the lid. This lid includes a first pair of electrical contacts mounted thereto in electrical communication with the incandescent bulb, and the power supply includes a second pair of cooperative electrical contacts operative to releasably and matably engage the first pair of electrical contacts.

In order to simulate the appearance of an actual candle, the light assembly also includes a bulb cap and a decorative skirt. The bulb cap may be mounted to the lid by a pair of fasteners and provides a protective covering for the incandescent bulb. Preferably, this bulb cap simulates the appearance of a flame. The decorative skirt is mounted to the lid, and preferably simulates the appearance of wax drippings.

These and other objects of the present invention will become more readily appreciated and understood from a consideration of the following detailed description of the exemplary embodiment of the present invention when taken in conjunction with the accompanying drawings, in which:

DETAILED DESCRIPTION OF THE EXEMPLARY EMBODIMENT(S)

Figure 1:
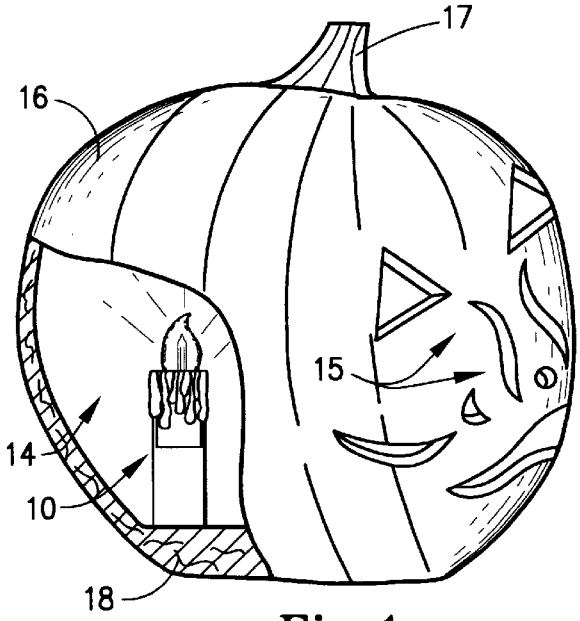
FIG. 1 is a perspective view of the illumination device according to the exemplary embodiment of the present invention, with the illumination device shown in the interior of a carved pumpkin.

The illumination device 10 according to the exemplary embodiment of the present invention is generally introduced in FIGS. 1–4. With initial reference to FIG. 1, illumination device 10 is adapted to be placed on a support surface 12 to illuminate a surrounding area. By way of example only and not of limitation, illumination device 10 is particularly adapted to be inserted into an interior 14 of an object, such as a carved pumpkin 16, to illuminate the interior 14. Pumpkin 16 has a fleshy bottom wall 18 which illumination device 10 penetrates, as described more thoroughly below with reference to FIGS. 5 and 6. When energized, illumination device 10 emits a bright light which enhances the appearance of various design features 15 carved into pumpkin 16. Unlike prior pumpkin lighting techniques, illumination device 10 does not utilize an actual flame, so there is no need to remove the stem 17 of pumpkin 16 to provide a chimney for the escape of smoke and heat.

Figure 2:
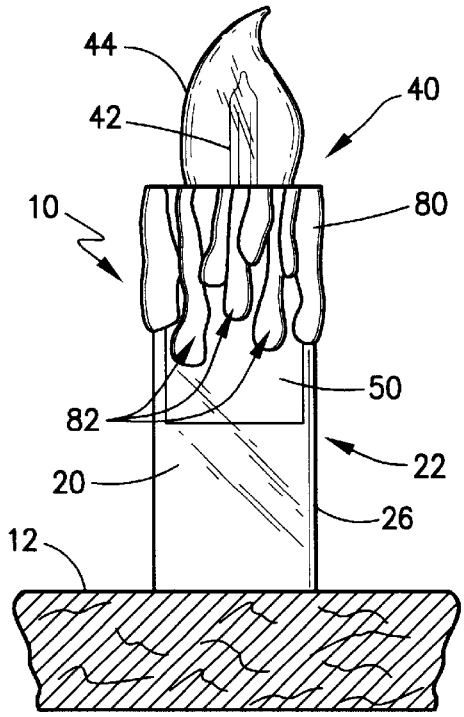
FIG. 2 is an enlarged side view in elevation of the exemplary embodiment of the illumination device of the present invention shown in FIG. 1, with the illumination device disposed on a support surface, such as pumpkin's fleshy bottom wall.
Figure 3:
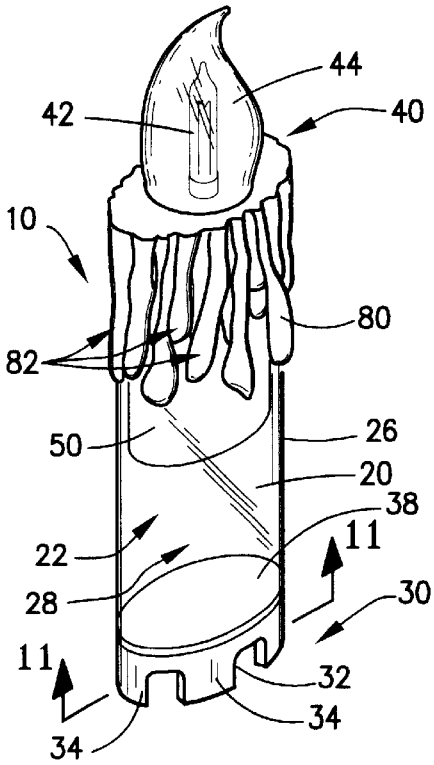
FIG. 3 is a perspective view of the illumination device of the illumination device shown in FIGS. 1 and 2.
Figure 4:
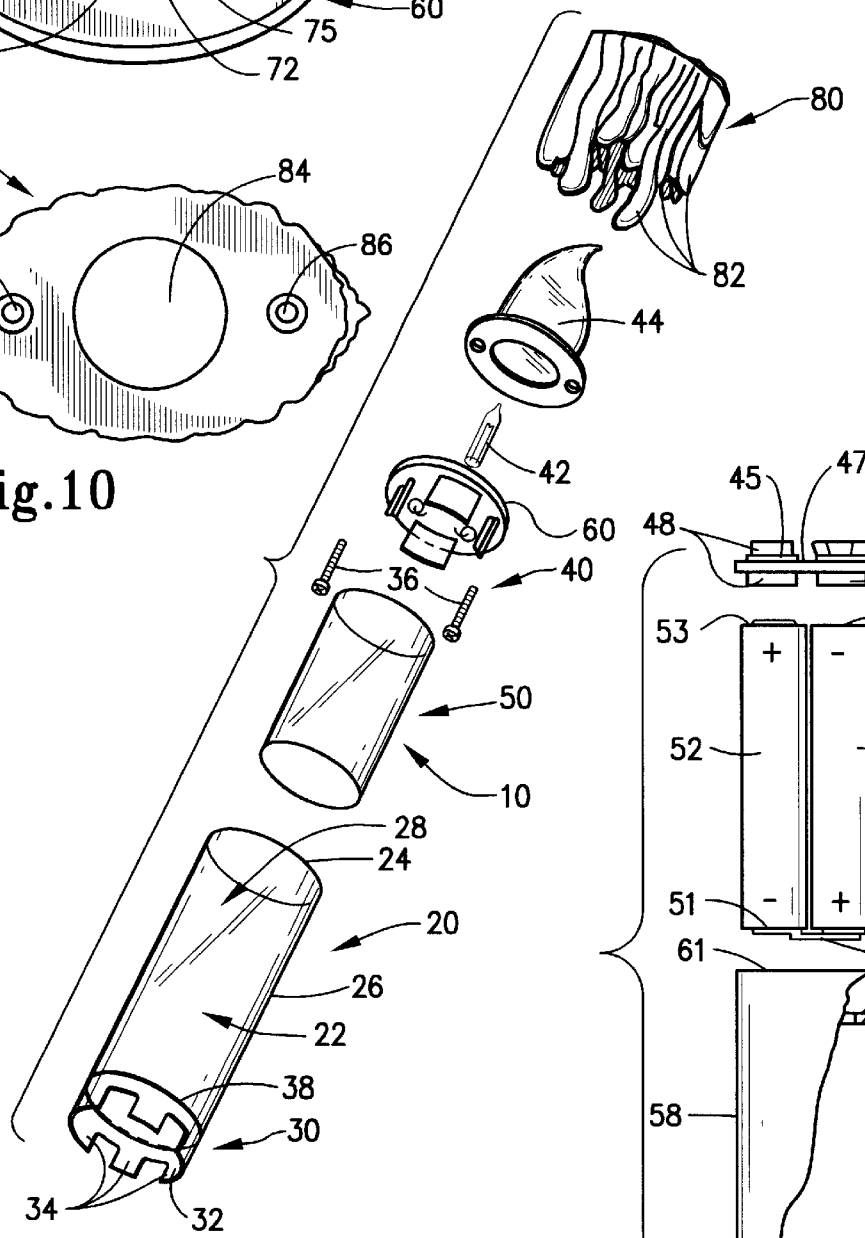
FIG. 4 is an exploded perspective view of the illumination device of the present invention shown in FIGS. 1–3.

Reference to FIGS. 2–4, it may be seen that illumination device 10 broadly includes a stand 20 and a light assembly 40. Stand 20 includes a base portion 30 preferably configured to penetrate the fleshy bottom wall of the pumpkin and a body portion 22 which extends upwardly from base portion 30 in a longitudinal direction to terminate at an open upper end 24. Stand 20, which may be integrally molded from translucent plastic material, is preferably in the form of a housing having an elongated tubular sidewall 26 which extends from base portion 30 to terminate at open upper end 24. Preferably, base portion 30 is formed as an extension of sidewall 26 and terminates in a lower base portion edge 32.

Figure 10:
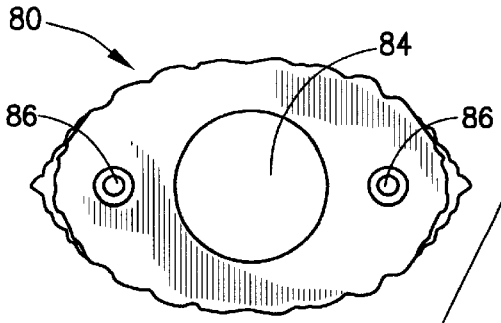
FIG. 10 is an enlarged bottom plan view of the illumination device's decorative skirt shown in FIGS. 1–4.
Figure 9:
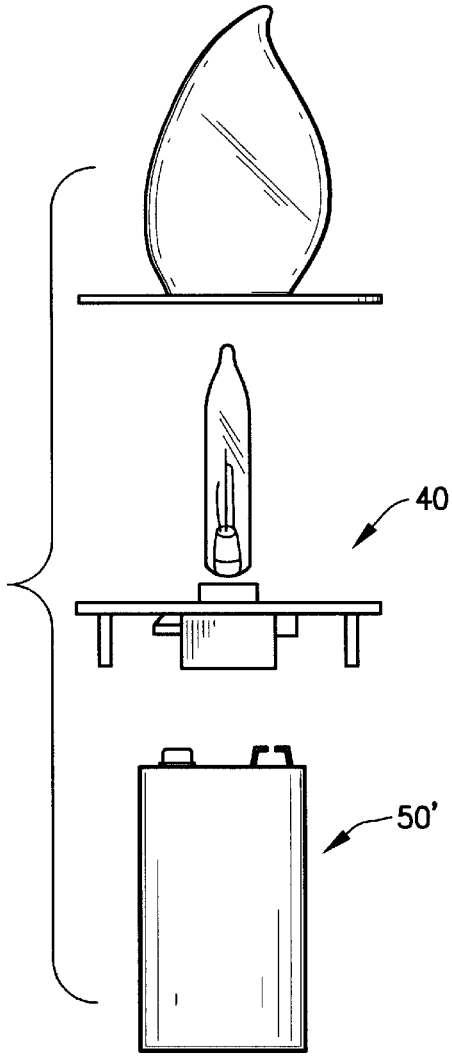
FIG. 9 is an exploded side view in elevation of the illumination device's light assembly where a single battery electric power supply is employed.

Light assembly 40 broadly includes an incandescent bulb 42 and a self-contained electric power supply 50. A lid 60 is releasably connectable to power supply 50, as discussed more thoroughly below with reference to FIGS. 9 and 10. Lid 60 also supports an incandescent bulb 42 so that bulb 42 projects upwardly therefrom. Power supply 50 is suspended downwardly from lid 60 within an interior 28 of stand 20. A bulb cap 44 is adapted to mount to lid 60 to provide a protective covering for incandescent bulb 42. Bulb cap 44 may be integrally molded from a transparent plastic material and, as shown in FIGS. 1–4, preferably simulates the appearance of a candle flame to enhance the overall visual effect of illumination device 10.

The ensemble of power supply 50, lid 60, incandescent bulb 42 and bulb cap 44 are received by a decorative skirt 80 which is sized and adapted to surround upper end 24 and depend downwardly along an outer sidewall surface of stand 20. Decorative skirt 80 is also preferably an integral mold of plastic material having a plurality of surrounding design features 82 which simulate the appearance of wax drippings and further enhance the overall visual effect of illumination device 10. As best shown in FIGS. 1 and 3 decorative skirt 80 is sized and adapted to surround sidewall 26 so that is partially conceals power supply 50 from view.

Figure 5:
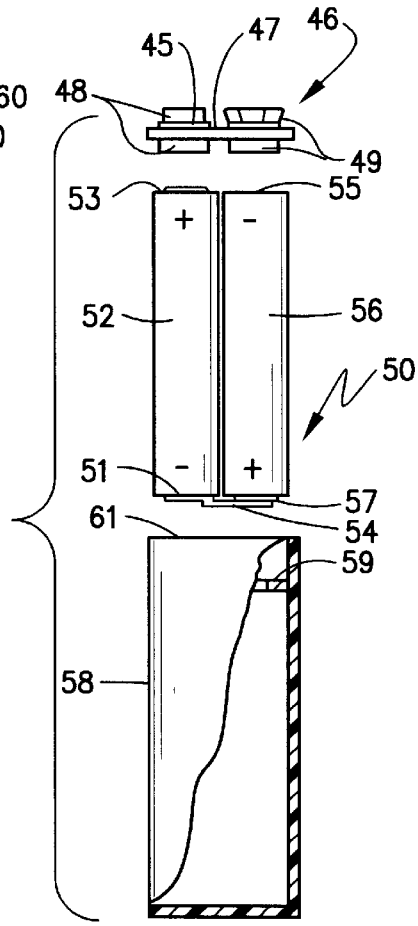
FIG. 5 is an exploded side view in elevation showing a preferred construction for the illumination device's self-contained electric power supply.

A preferred construction for self-contained power supply 50 may be appreciated now with reference to FIG. 5. Here, a pair of conventional M batteries 52 and 56 are electrically connected in series and supported within a battery chamber 58. More specifically, first battery 52 has its negative terminal 51 electrically interconnected to the positive terminal 57 of second battery 56 via conductive armature 54. A conversion cap 46 is provided and adapted to mount to the positive terminal 53 of first battery 52 and the negative terminal 55 of second battery 56 to effectively convert these dual batteries into a single power supply having positive and negative terminals which correspond to those of a conventional nine-volt battery. To this end, conversion cap 46 includes a nonconductive plate 47 having positive contacts 48 adapted to matably engage positive terminal 53 and negative contacts 49 adapted to matably engage negative terminal 55. It is preferred that nonconductive plate 47 has a surrounding lip margin 45 so that, when batteries 52 and 56 are mounted thereto, both plate 47 and batteries 52, 56 can be inserted into chamber 58 in such manner that lip margin 45 rests on an annular ledge 59 formed within chamber 58. This ledge 59 is located a spaced distance from the top 61 of chamber 58 to properly position conversion cap 46 therein so that it can releasably engage lid 60. Of course, the ordinarily skilled artisan should readily appreciate that FIG. 8 only illustrates a preferred construction for self-contained power supply 50 for use with illumination device 10 so that numerous other constructions for power supply 50 are within the purview of the present invention as within the skill of the artisan in this field.

Figure 6:
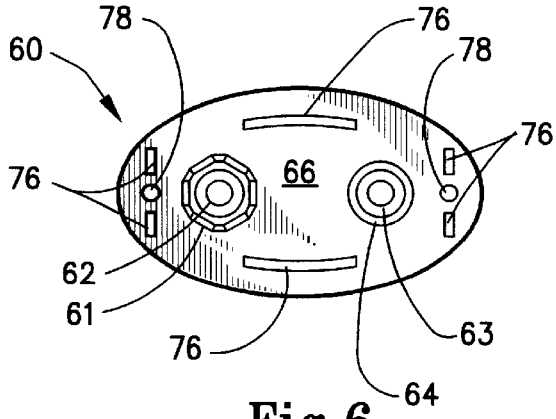
FIG. 6 is a top plan view of the lid which forms part of the illumination device's light assembly.
Figure 7:
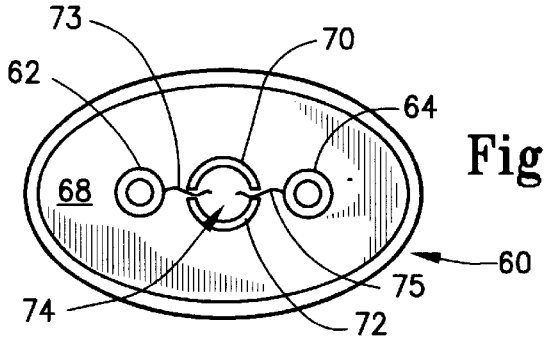
FIG. 7 is a bottom plan view of the light assembly's lid shown in FIG. 6.
Figure 8:
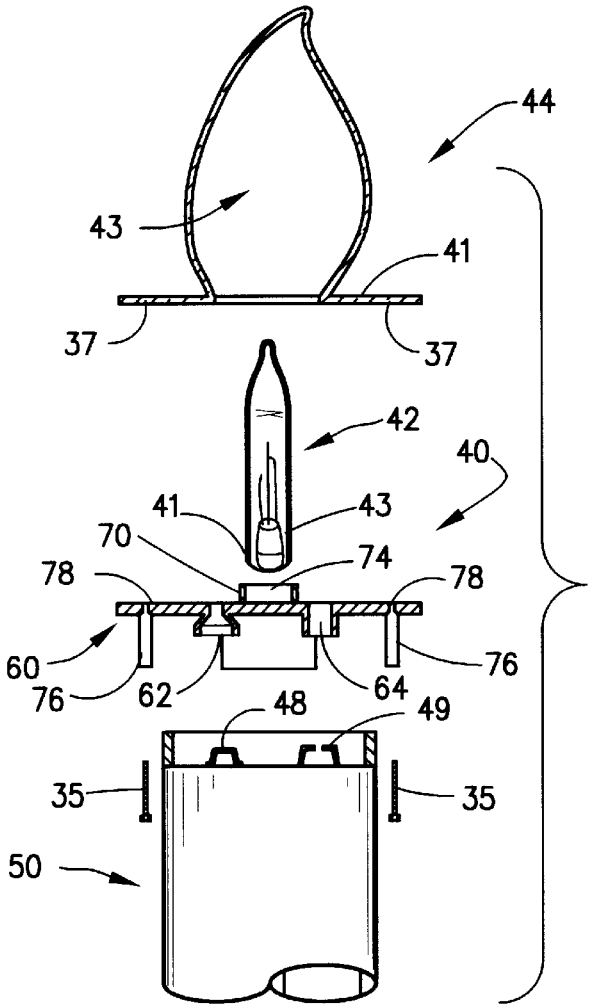
FIG. 8 is an exploded side view in cross-section showing an exemplary construction for the illumination device's light assembly where a dual battery electric power supply is employed.

With reference now to FIGS. 6 and 7, lid 60 includes a cooperative pair of riveted electrical contacts 62 and 64 which are adapted to releasably and matably engage contacts 48 and 49 associated with conversion cap 46. Thus, a first riveted contact 62 has a first contact portion 61 which projects downwardly from a lower surface 66 of lid 60 to define a positive terminal which is adapted to matably engage positive terminal 48 of conversion cap 46. Likewise, lid 60 also includes a second riveted contact 64 having a second contact portion 63 which projects downwardly from lower surface 66 to define a negative terminal adapted to matably engage the negative terminal 49 associated with conversion cap 46. Projecting upwardly from an upper surface 68 of lid 60 is a pair of spaced apart curved walls 70 and 72 which define a lid seat 74 that is sized adapted to receive incandescent bulb 42, as best shown in FIG. 8. A pair of electrically conductive leads 73 and 75 are, respectively, connected to first and second riveted contacts 62 and 64 and extend into lid seat 74 to electrically communicate with leads 41 and 43 associated with incandescent bulb 42

With the foregoing discussion in mind with reference to the preferred constructions for the self-contained power supply 50 and the lid 60 which form component parts of light assembly 40, the assemblage of light assembly 40 may now be best appreciated with further reference to FIGS. 6–8. As discussed above, self-contained power supply 50 is mounted to lid 60 in such a manner that its contact terminals 48 and 49 respectively engage the first and second riveted contacts 62 and 64 associated with lid 60. Lid 60 includes a plurality of prongs 76 which project downwardly from lower surface 66 along with a pair of installation holes 78. Prongs 76 operate both to guide contacts 48 and 49 respectively into releasably engagement with riveted contacts 62 and 64 and to assist in frictionally maintaining self-contained power supply 50 in contact with lid 60. Incandescent bulb 42 is sized and adapted for close fitted engagement within lid seat 74 and bulb cap 44 is placed over incandescent bulb 42 so that incandescent bulb 42 is disposed within an interior 43 of bulb cap 44.

In order to securely fasten bulb cap 44 to lid 60, bulb cap 44 is provided with a surrounding brim 41 through which is formed a pair of spaced apart mounting holes 37. Mounting holes 37 are alignable with installation holes 78 formed through lid 60 and a pair of screws 35 are adapted to extend through these mounting holes and installation holes to fasten bulb cap 44 to lid 60. Once assembled in this manner, bulb cap 44 may be received through a central opening 84 formed through skirt 80 so that bulb cap 44 projects upwardly therefrom, as best shown in FIGS. 1–3. Screws 35 are also sized and adapted to be received in fastening holes 86 formed in skirt 80 (See FIG. 10) to complete light assembly 40. Thereafter, light assembly 40 is attached to stand 20 such that decorative skirt 80 surrounds upper end 24 and depends downwardly along side an outer surface of sidewall 26. As discussed above and illustrated in FIG. 9, a single 9 volt battery power supply 50' may be substituted for dual battery power supply 50'.

Figure 11:
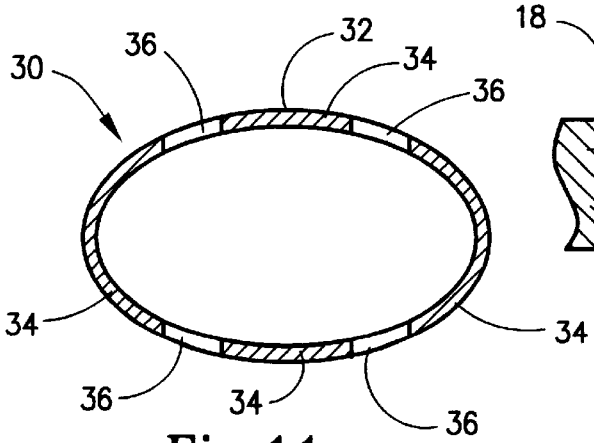
FIG. 11 is a cross-sectional view of the base portion for the illumination device's stand, as viewed about lines 11—11 in FIG. 3.
Figure 12:
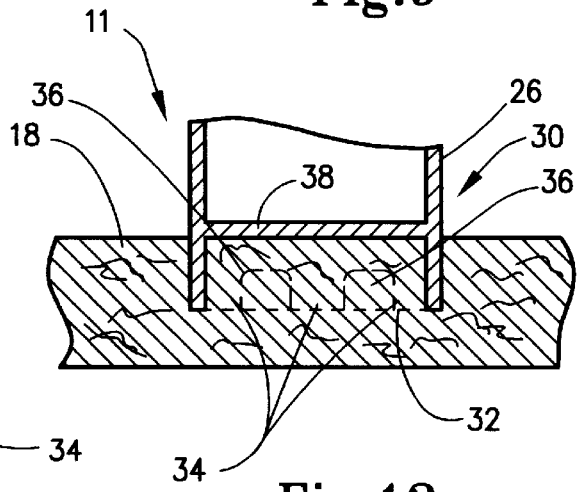
FIG. 12 is a side view in cross-section of the base portion of the illumination device of the present invention securely disposed in the fleshy bottom wall of a pumpkin.

As discussed above, stand 20 has a base portion configured to penetrate the fleshy bottom wall of a pumpkin in order to support the stand's upper end 24 in an upright position above fleshy bottom wall. To this end, and as best shown in FIGS. 11 and 12, the base portion edge 32 of base portion 30 is serrated so that base portion 30 includes a plurality of downwardly projecting, rectangularly shaped teeth 34 operative to penetrate fleshy bottom wall 18. The serration of base portion edge 32 results in a plurality of arcuate cut outs 36 formed in base portion 30.

As shown in FIGS. 3, 4 and 12, base portion 30 also includes a transversely extending base wall 38 positioned in spaced relation to base portion edge 32. Base wall 38 extends within the interior of the stand's housing to define a bottom therefor. Importantly also, base wall 38 functions as a limit stop which operates to resist insertion of base portion 30 into the pumpkin's fleshy bottom wall 18 beyond a selected penetration depth, as best shown in FIG. 12. As such, when a normal force "N" (indicated by an arrow "N" in FIG. 12) is applied for advancing illumination device 10 into fleshy bottom wall 18, base wall 38 and teeth 34 act to securely plant the illumination device 10 within the fleshy bottom wall 18 to reduce the risk of inadvertent tipping during use.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiment of the present invention without departing from the inventive concepts contained herein.

We claim:

1. An illumination device adapted to be placed in an interior of an object that has an interior support surface, said illumination device for illuminating a surrounding area, comprising:

(a) a housing having a housing interior sized and adapted to receive an electric power supply, said housing including a base portion operative to support said housing in an upright orientation relative to the interior support surface of the object and an upper end portion opposite said base portion, said base portion including a plurality of piercing edges adapted to penetrate the interior support surface of the object;

(b) a light source disposed at said upper end portion; and (c) a decorative skirt surrounding said upper end portion and depending downwardly alongside an outer surface thereof.

2. An illumination device according to claim 1 wherein said decorative skirt simulates the appearance of wax drippings.

3. An illumination device according to claim 1 including a battery suspended within said housing, said battery defining the electric power supply.

4. An illumination device according to claim 3 wherein said housing is formed of a translucent material and wherein said decorative skirt is sized to partially conceal said battery from view.

5. An illumination device according to claim 1 comprising a pair of batteries suspended within said housing, said batteries defining the electric power supply.

6. An illumination device according to claim 5 including a battery chamber sized and adapted to house said batteries.

7. An illumination device adapted to be placed in a hollowed-out interior of a pumpkin that has a fleshy bottom wall to illuminate the interior, comprising:

(a) a stand having a base portion and a body portion extending upwardly from said base portion in a longitudinal direction to terminate at an upper end, said base portion configured to penetrate the fleshy bottom wall and including a transversely extending limit stop operative to resist insertion of said base portion into the fleshy bottom wall beyond a selected penetration depth, thereby to support the upper end in an upright position above the fleshy bottom wall; and (b) a light assembly supported relative to said upper end in an elevated position above said base portion.

8. An illumination device according to claim 7 wherein said base portion is formed to include a plurality of downwardly projecting teeth for penetrating the fleshy bottom wall.

9. An illumination device according to 8 wherein said limit stop is in spaced relation to said teeth.

10. An illumination device according to claim 7 wherein said stand includes an elongated tubular side wall extending upwardly from said base portion to terminate at an open mouth thereby surrounding a stand interior, said base portion formed as an extension of said side wall and including a lower base portion edge.

11. An illumination device according to claim 10 wherein said light assembly includes a self-contained power supply and an incandescent bulb in electrical communication with said power supply.

12. An illumination device according to claim 11 wherein said self-contained power supply is disposed within the stand interior between said base portion and said upper end.

13. An illumination device according to claim 7 wherein said light assembly includes a self-contained power supply and an incandescent bulb in electrical communication with said power supply.

14. An illumination device according to claim 13 including a bulb cap operative to provide a protective covering for said incandescent bulb said cap simulating the appearances of a flame.

15. An illumination device according to claim 13 including a decorative skirt surrounding said upper end and depending downwardly alongside an outer side wall surface thereof, said decorative skirt simulating the appearance of wax drippings.

16. An illumination device adapted to illuminate a surrounding area, comprising:

(a) a stand including a base portion and an elongated tubular side wall extending from said base portion to terminate at an open upper end, said side wall surrounding a stand interior; and (b) a light assembly supported by said stand in an elevated position above said base portion, said light assembly including a lid sized and adapted to rest on said open upper end, a self-contained power supply suspended downwardly from said lid within the stand interior, and an incandescent bulb in electrical communication with said power supply.

17. An illumination device according to claim 16 wherein said incandescent bulb is supported by said lid and projects upwardly therefrom.

18. An illumination device according to claim 17 wherein said incandescent bulb projects upwardly from said lid and wherein said power supply is suspended downwardly from said lid.

19. An illumination device according to claim 17 wherein said lid includes a lid seat sized and adapted to receive said incandescent bulb.

20. An illumination device according to claim 16 wherein said lid includes a first pair of electrical contacts mounted thereto in electrical communication with said incandescent bulb and wherein said power supply includes a second pair of cooperative electrical contacts operative to releasably and matably engage said first pair of electrical contacts.

21. An illumination device according to claim 16 wherein said light assembly includes a bulb cap mounted to said lid, said bulb cap operative to provide a protective covering for said incandescent bulb.

22. An illumination device according to claim 21 wherein said light assembly includes a pair of fasteners operative to releasably secure said lid to said bulb cap.

23. An illumination device according to claim 16 wherein said light assembly includes a decorative skirt mounted to said lid, said skirt sized and adapted to receive said open upper end whereby said power supply is suspended within said interior.

24. An illumination device according to claim 23 wherein said decorative skirt simulates the appearance of wax drippings.

25. An illumination device adapted to be placed in an interior of an object that has an interior support surface, said illumination device for illuminating a surrounding area, comprising:

(a) a housing having a housing interior sized and adapted to receive an electric power supply, said housing including a base portion operative to support said housing in an upright orientation relative to the interior support surface of the object and an upper end portion opposite said base portion;

(b) a light source disposed at said upper end portion; and (c) a decorative skirt removably disposed in a surrounding relationship about said upper end portion and depending downwardly alongside an outer surface thereof.

26. An illumination device according to claim 25 wherein said electric power supply is defined by a battery that is adapted to be suspended within said housing relative to said decorative skirt.

* * * * *

UNITED STATES PATENT AND TRADEMARK OFFICE

CERTIFICATE OF CORRECTION

PATENT NO. : 6,309,092 B1
DATED : October 30, 2001
INVENTOR(S) : Bardeen et al.

It is certified that error appears in the above-identified patent and that said Letters Patent is hereby corrected as shown below:

Column 4,
Line 51, "conventional M batteries", should read -- conventional AA batteries --.

Signed and Sealed this

Sixth Day of May, 2003

JAMES E. ROGAN
*Director of the United States Patent and Trademark Office*